US011263854B2

(12) United States Patent
Schutzmann et al.

(10) Patent No.: US 11,263,854 B2
(45) Date of Patent: Mar. 1, 2022

(54) MAGNETIC TESTING OF VALUABLE DOCUMENTS

(71) Applicant: GIESECKE+DEVRIENT CURRENCY TECHNOLOGY GMBH, Munich (DE)

(72) Inventors: Jurgen Schutzmann, Pfaffenhofen (DE); Steffen Schmalz, Munich (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 17/289,006

(22) PCT Filed: Oct. 25, 2019

(86) PCT No.: PCT/EP2019/000300
§ 371 (c)(1),
(2) Date: Apr. 27, 2021

(87) PCT Pub. No.: WO2020/088790
PCT Pub. Date: May 7, 2020

(65) Prior Publication Data

US 2021/0407241 A1 Dec. 30, 2021

(30) Foreign Application Priority Data

Oct. 30, 2018 (DE) ..... 10 2018 008 519.9

(51) Int. Cl.
*G07F 7/00* (2006.01)
*G07D 7/004* (2016.01)
(Continued)

(52) U.S. Cl.
CPC ..... *G07D 7/004* (2013.01); *B42D 25/369* (2014.10); *G07D 7/04* (2013.01)

(58) Field of Classification Search
CPC ..... G06Q 20/352; G06Q 20/341; G06Q 20/3563; G06Q 20/4093
(Continued)

(56) References Cited

U.S. PATENT DOCUMENTS 8,544,630 B2 10/2013 Schutzmann et al.
8,910,869 B2 12/2014 Schutzmann et al.
(Continued)

FOREIGN PATENT DOCUMENTS

DE 102007025939 A1 12/2008
DE 102009039588 A1 3/2011
DE 102011106263 A1 12/2011

OTHER PUBLICATIONS

International Search Report and Written Opinion from PCT Application No. PCT/EP2019/000300, dated Mar. 11, 2020.

*Primary Examiner* — Daniel A Hess
(74) *Attorney, Agent, or Firm* — Workman Nydegger

(57) ABSTRACT

The magnetic checking of value documents with highly coercive and/or lowly coercive magnetic regions, involves after the magnetization of all magnetic regions in a first direction, a second magnetization is effected, in which only the lowly coercive magnetic material is re-magnetized, but the highly coercive magnetic material remains aligned in the first magnetization direction. Magnetic signals are detected with an inductive magnetic detector, having several measuring tracks transverse to the transport direction of the value document. To evaluate the magnetic signals of the measuring tracks, the strongest two local minima and/or maxima of the respective magnetic signal are ascertained by a measuring track as a function of time. A minima comparison value and/or maxima comparison value of the respective measuring track is determined. The magnetic coding of the security element is checked on the basis of the minima
(Continued)

comparison values and/or maxima comparison values of the measuring tracks.

15 Claims, 4 Drawing Sheets

(51) Int. Cl.
*B42D 25/369* (2014.01)
*G07D 7/04* (2016.01)

(58) Field of Classification Search
USPC ..... 235/380
See application file for complete search history.

(56) References Cited

U.S. PATENT DOCUMENTS

| | | | | |
|---|---|---|---|---|
| 9,336,640 | B2 | 5/2016 | Schutzmann et al. | |
| 9,703,994 | B2 * | 7/2017 | Paul | G07D 7/04 |
| 2010/0219245 | A1 | 9/2010 | Schutzmann et al. | |
| 2012/0160632 | A1 | 6/2012 | Schutzmann et al. | |
| 2013/0082105 | A1 | 4/2013 | Schutzmann et al. | |
| 2016/0055358 | A1 * | 2/2016 | Paul | G06K 7/087<br>235/450 |

* cited by examiner

MAGNETIC TESTING OF VALUABLE DOCUMENTS

BACKGROUND

The invention relates to a method and a checking apparatus for the magnetic checking of value documents, such as, e.g., banknotes, checks, cards, tickets, coupons, and a value document processing apparatus.

From the prior art it is known to equip value documents with security elements, such as security strips or also security threads, which contain magnetic material. The magnetic material can be applied to the security element either continuously or only in some regions, for example in the form of a coding. For magnetically coding a security element there serves for example a certain sequence of magnetic and non-magnetic regions that is characteristic of the value document. Moreover, it is known to employ different magnetic materials for a magnetic coding, e.g. with different coercive field strengths. In some magnetic codings, two differently coercive magnetic materials are used, from which lowly coercive and highly coercive magnetic regions are formed, which are arranged on the security element.

Further, it is known to machine-check banknotes with security threads which have a magnetic coding consisting of differently coercive materials. In this case, the banknotes are transported through one or several magnetic field regions for their magnetization, wherein they first pass through a strong magnetic field that magnetizes both the highly and the lowly coercive magnetic regions. The banknotes subsequently pass through a weaker magnetic field that only changes the magnetization direction of the lowly coercive magnetic regions, while the highly coercive magnetic regions remain magnetized in the same fashion. The resulting magnetization is checked by one or several magnetic detectors arranged behind the magnetic field regions. Magnetoresistive detectors, AMR elements, GMR elements, TMR elements or Hall elements, which require little space, are usually employed as magnetic detectors. These are arranged in large numbers or density transversely to the transport direction of the value document in order to enable a high spatial resolution, so that finely structured magnetic codes (with short magnetic regions) can also be read. However, such magnetic detectors are very complex to manufacture.

In addition, inductive magnetic detectors are known which usually have only a few measuring tracks transverse to the transport direction of the value document and offer too little spatial resolution to read finely structured magnetic codes. Inductive magnetic detectors are therefore often only employed to detect the presence of a magnetic security element. It is also known to replace an inductive magnetic detector by two or several of the above-mentioned other detector elements, for example by GMR elements, and to interconnect these detector elements electronically so that their magnetic signal is similar to that of an inductive magnetic detector. The magnetic signal can then advantageously be subjected to the same evaluation that can also be employed for the magnetic signal of the inductive magnetic detector.

SUMMARY

The invention is therefore based on the object of proposing an evaluation for the magnetic signal produced by a security element of a magnetic detector, in particular an inductive magnetic detector, by means of which the magnetic coding of a security element can be checked.

The value document to be checked has a security element with one or several magnetic regions. The magnetic regions include, for example, one or several lowly coercive magnetic regions made of a lowly coercive magnetic material with a first coercive field strength and one or several highly coercive magnetic regions made of a highly coercive magnetic material with a second coercive field strength that is greater than the first coercive field strength, and possibly one or several combined magnetic regions, which have both the highly coercive and the lowly coercive magnetic material. Depending on the type of security element, it can have both highly coercive and lowly coercive magnetic regions, but it can also only have one type of these magnetic regions.

To check the value document, the value document or the security element of the value document is magnetized by a first magnetic field region whose magnetic field strength is greater than the first and second coercive field strengths. The magnetization of the highly coercive magnetic material (of a highly coercive and possibly of a combined magnetic region) and the magnetization of the lowly coercive magnetic material (of a lowly coercive and possibly of a combined magnetic region) are thereby aligned uniformly in a first magnetization direction. The value document or the security element is subsequently magnetized by a second magnetic field region whose magnetic field strength is greater than the first coercive field strength, but smaller than the second coercive field strength. The second magnetic field region is oriented in such a fashion that the magnetization of the lowly coercive magnetic material (of a lowly coercive and possibly of a combined magnetic region) is aligned in a second magnetization direction different from the first magnetization direction. The magnetization of the highly coercive magnetic material (of a highly coercive and possibly of a combined magnetic region) remains aligned unchanged in the first magnetization direction during the second magnetization.

The first and second magnetization of the security element by the first and second magnetic field region results in the magnetization of one or several lowly coercive magnetic regions possibly present on the security element being aligned in a different magnetization direction than the magnetization of one or several highly coercive magnetic regions possibly present on the security element. The first and second magnetic field regions can be spatially different regions of the same magnetic field that is produced by the same magnet(s). However, they can also be produced by the magnetic fields of several magnets. The first and second magnetic field regions can be supplied by the checking apparatus itself or by a value document processing apparatus in which the checking apparatus is contained. The first and second magnetization can also be carried out outside of such apparatus, however, for example by a magnetization device, in whose magnetic field regions the value documents are introduced manually or automatically for magnetization.

For a fully automatic check, the first and second magnetic field regions and a (in particular inductive) magnetic detector are supplied along a transport path of the value document, along which the value document is transported. The value document with the security element first passes through the first magnetic field region of a first magnetic field strength pointing in a first magnetic field direction, which magnetic field strength is greater than the coercive field strength of the two magnetic materials, and then the second magnetic field region of a second magnetic field strength pointing in a different, second magnetic field direction, which magnetic field strength is greater than the coercive field strength of the lowly coercive magnetic material, but is smaller than the coercive field strength of the highly coercive magnetic material. Accordingly, when the value document is transported along the transport path, both magnetic materials are initially magnetized in the first magnetic field region and subsequently only the lowly coercive magnetic material is re-magnetized in the second magnetic field region, whereas the magnetization of the highly coercive magnetic material produced by the first magnetic field region remains. The two magnetic materials are then magnetized in different magnetization directions.

After the first and second magnetizations, the value document with the security element is transported along a transport direction past a (in particular inductive) magnetic detector, which has several measuring tracks transverse to the transport direction of the value document. In the measuring tracks, the magnetic detector (at least in the region of the security element) detects a magnetic signal in each case as a function of time, i.e. as a function of the position along the transport direction of the value document transported past the magnetic detector. Instead of an inductive magnetic detector, magnetoresistive elements, AMR, GMR, TMR or Hall elements can also be employed, which are electronically connected to one another in a differential fashion or whose magnetic signals are subtracted from one another in such a fashion that the resulting magnetic signal is similar to that of an inductive magnetic detector.

The magnetic signals of the security element detected by the individual measuring tracks are evaluated. The two strongest local minima of the respective magnetic signal, which the respective magnetic signal of the respective measuring track has as a function of time or as a function of the position along the transport direction in the region of the security element, are ascertained for several or all measuring tracks. Alternatively or additionally, the two strongest local maxima of the respective magnetic signal can also be ascertained, which the respective magnetic signal of the respective measuring track has as a function of time or as a function of the position along the transport direction in the region of the security element. In the case of the minima evaluation, a minima comparison value of the respective measuring track is determined in each case for several of the measuring tracks by comparing the amplitude of the magnetic signal in the second strongest local minimum with the amplitude of the magnetic signal in the strongest local minimum. In the case of maxima evaluation, a maxima comparison value of the respective measuring track is determined in each case for several of the measuring tracks by comparing the amplitude of the magnetic signal in the second strongest local maximum with the amplitude of the magnetic signal in the strongest local maximum. The magnetic coding of the security element is checked on the basis of the minima comparison values of several or all measuring tracks and/or on the basis of the maxima comparison values of several or all measuring tracks. An evaluation of not all, but only several (preferably adjacent) measuring tracks can be sufficient if the magnetic coding is repeated along the security element. Further, those measuring tracks that detect the edge of the security element can be ignored when checking the magnetic coding.

A local minimum/maximum of the respective magnetic signal is that point of the magnetic signal at which the amplitude of the magnetic signal as a function of time or as a function of position along the transport direction assumes a local minimum/a local maximum. The (second) strongest local minimum is that local minimum of the respective magnetic signal at which the amplitude of the magnetic signal of all local minima has the (second) largest distance from the zero point or from the offset of the magnetic signal into the negative. The (second) strongest local maximum is that local maximum of the respective magnetic signal at which the amplitude of the magnetic signal of all local maxima has the (second) largest distance from the zero point/offset of the magnetic signal into the positive.

On the basis the minima comparison values and/or on the basis of the maxima comparison values of the respective measuring track, it can be checked whether the security element has a lowly coercive or a highly coercive magnetic region or possibly a combined magnetic region in the respective section of the security element (viewed transversely to the transport direction of the value document) whose magnetic signal has been detected by the respective measuring track. Each magnetic region can either be identified as a combined magnetic region or as a highly coercive or lowly coercive magnetic region. The magnetic coding can also be checked on the basis of the minima comparison values and/or on the basis of the maxima comparison values to determine whether the magnetic coding has magnetic regions with different coercive field strengths (different magnetic materials) or only magnetic regions of the same coercive field strength (made of the same magnetic material).

When comparing the two strongest minima or the two strongest maxima, their difference or their ratio is computed, for example. The minima comparison value is, for example, the minima difference $u=m2-m1$ or $u=m1-m2$ between the amplitude m2 of the magnetic signal in the second strongest local minimum and the amplitude m1 of the magnetic signal in the strongest local minimum. Analogously, the maxima comparison value is, for example, the maxima difference $U=M2-M1$ or $U=M1-M2$ between the amplitude M2 of the magnetic signal in the second strongest local maximum and the amplitude M1 of the magnetic signal in the strongest local maximum.

Alternatively, the minima comparison value can be the minima ratio $v=m2/m1$ or $v=m1/m2$ between the amplitude m2 of the magnetic signal in the second strongest local minimum and the amplitude m1 of the magnetic signal in the strongest local minimum, and the maxima comparison value the maxima ratio $V=M2/M1$ or $V=M1/M2$ between the amplitude M2 of the magnetic signal in the second strongest local maximum and the amplitude M1 of the magnetic signal in the strongest local maximum.

The absolute amount of the strongest local minimum (global minimum) of the respective magnetic signal or the absolute amount of the strongest local maximum (global maximum) of the respective magnetic signal, which the respective magnetic signal of the respective measuring track as a function of time or as a function of position has along the transport direction in the region of the security element can be compared with an insignificance threshold. If the insignificance threshold is exceeded, it can be concluded that the security element has a (e.g. highly coercive or lowly coercive or possibly combined) magnetic region in the respective section (transverse to the transport direction) whose magnetic signal has been detected by the respective measuring track. Preferably, only when the insignificance threshold is exceeded it is evaluated whether the security element has a highly coercive or a lowly coercive (or possibly a combined) magnetic region in the respective section whose magnetic signal has been detected by the respective measuring track. If the insignificance threshold is undershot, this evaluation is not carried out, but from the undershooting the conclusion is drawn that the security element has neither a lowly coercive nor a highly coercive magnetic region (and also no combined magnetic region) in the respective section whose magnetic signal has been detected by the respective measuring track.

For example, the respective minima comparison value or the respective maxima comparison value is compared with a first threshold (and possibly also further thresholds) for one or several measuring tracks of the magnetic detector. Information about the magnetic coding of the security element can be obtained based on whether the minima comparison values of the individual measuring tracks exceed or undershoot the first threshold or based on whether the maxima comparison values of the individual measuring tracks exceed or undershoot the first threshold. For example, depending on whether the minima comparison value of the respective measuring track exceeds or undershoots the first threshold and/or depending on whether the maxima comparison value of the respective measuring track undershoots or exceeds the first threshold, it can be decided whether the security element has a highly coercive (or possibly a combined) magnetic region or else has a lowly coercive magnetic region in the respective section whose magnetic signal has been detected by the respective measuring track.

The form of the inductive magnetic signal depends on the sequence in which the two inductive measuring heads of the inductive magnetic detector are connected to one another in difference. If the differential circuit is reversed, the positive and negative amplitudes of the magnetic signal are reversed, whereby the maximum and minimum are interchanged. The evaluation logic must therefore be adjusted in dependence on this, i.e. it must be decided, depending on the sequence selected for differential circuit, whether a magnetic region is identified as a lowly coercive or a highly coercive magnetic region when the first threshold is exceeded or undershot.

If, for example, an inductive sensor is employed as in the example of FIG. 1, a decision is made in the case that the minima comparison value of the respective measuring track exceeds the first threshold and/or that the maxima comparison value of the respective measuring track undershoots the first threshold, that the security element has a highly coercive (or possibly a combined) magnetic region in the respective section whose magnetic signal has been detected by the respective measuring track. And in the case that the minima comparison value of the respective measuring track undershoots the first threshold and/or that the maxima comparison value of the respective measuring track exceeds the first threshold, it is decided that the security element has a lowly coercive magnetic region in the respective section whose magnetic signal has been detected by the respective measuring track.

However, if an inductive sensor with reversed differential circuit is employed or the first and second magnetization directions are interchanged, in the case that the minima comparison value of the respective measuring track undershoots the first threshold and/or that the maxima comparison value of the respective measuring track exceeds the first threshold, it is decided that the security element has a highly coercive (or possibly a combined) magnetic region in the respective section whose magnetic signal has been detected by the respective measuring track. And in the case that the minima comparison value of the respective measuring track exceeds the first threshold and/or that the maxima comparison value of the respective measuring track undershoots the first threshold, it is decided that the security element has a lowly coercive magnetic region in the respective section whose magnetic signal has been detected by the respective measuring track.

When checking the magnetic coding of the security element, it can be decided on the basis of the minima comparison values and/or on the basis of the maxima comparison values of several measuring tracks whether the security element is assigned to a first or a second security element category. The first security element category includes, for example, such security elements that also have highly coercive magnetic material, e.g. have one or several highly coercive magnetic regions and/or one or several combined magnetic regions. The first security element category is referred to, for example, as a "multicode security element". The second security element category includes those security elements that have no highly coercive magnetic material, e.g. have exclusively lowly coercive magnetic regions. The second security element category is referred to, for example, as a "no multicode security element".

The security element, for example, is assigned to the first security element category if in a minimum number n (natural number n) of measuring tracks the minima comparison value computed for the respective measuring track exceeds the first threshold and/or in a minimum number n of measuring tracks the maxima comparison value computed for the respective measuring track undershoots the first threshold. Otherwise (if neither the respective minima comparison value exceeds the first threshold for the minimum number of measuring tracks nor the respective maxima comparison value undershoots the first threshold for the minimum number of measuring tracks) the security element is assigned to the second security element category. This is the case, for example, if the exceeding or undershooting is observed in none of the measuring tracks or if the number of measuring tracks in which the first threshold is exceeded or undershot is smaller than the minimum number n.

In the case of an inductive sensor with reverse differential circuit, the security element is assigned to the first category of security elements if, in a minimum number n of measuring tracks, the minima comparison value computed for the respective measuring track undershoots the first threshold and/or in a minimum number n of measuring tracks the maxima comparison value computed for the respective measuring track exceeds the first threshold. Otherwise the security element is assigned to a second category of security elements.

The category assignment of the security element is possible with the aid of the comparison with the first threshold. As an alternative to comparing with a threshold, the category assignment could also be based on the distribution or standard deviation of the results of the minima comparison along the security element. If the standard deviation was great, the security element would be assigned to a first security element category ("security element with differently coercive magnetic regions") and if the standard deviation was small, the security element would be assigned to a second security element category ("security element with only one type of magnetic regions").

Optionally, the respective minima comparison value and/or the respective maxima comparison value can additionally be compared with a second threshold for one or several measuring tracks of the magnetic detector. In the case that the minima comparison value of the respective measuring track and/or the maxima comparison value of the respective measuring track lies between the first and that of the second threshold, it can be concluded that the security element has a combined magnetic region in the respective section whose magnetic signal has been detected by the respective measuring track. If the magnetic coding of the security element is checked on the basis of the minima comparison values of several of the measuring tracks, a second threshold is employed which lies above the first threshold. And if the magnetic coding of the security element is checked on the basis of the maxima comparison values of several of the measuring tracks, a second threshold is selected which lies below the first threshold.

The highly coercive and the lowly coercive magnetic material of the combined magnetic region are, for example, arranged on top of one another. Alternatively, the combined magnetic region has the highly coercive and the lowly coercive magnetic material in the form of a mixture. The combined magnetic region can have the same or different amounts of the highly coercive and the lowly coercive magnet material. It can be configured in such a fashion that the highly coercive magnetic material of the combined magnetic region and the lowly coercive magnetic material of the combined magnetic region have substantially the same remanent flux density, wherein the combined magnetic region in particular contains the same amounts of the highly coercive and of the lowly coercive magnetic material.

The invention also relates to a checking apparatus which is adapted to check the above value document, which is transported along a transport direction past a magnetic detector, in particular an inductive magnetic detector, of the checking apparatus. The checking apparatus has the (in particular inductive) magnetic detector, which has several measuring tracks transverse to the transport direction of the value document and is adapted to detect in the measuring tracks (at least in the region of the security element) a magnetic signal in each case as a function of time or as a function of position along the transport direction of the value document. For each measuring track, the magnetic detector has, for example, an inductive measuring head with two measuring coils, which are arranged one after the other in the transport direction of the value document. The two measuring coils are preferably connected to one another in difference and the difference signal of the two measuring coils is employed as the magnetic signal of the respective measuring track. Alternatively, instead of one measuring coil in each case, two magnetoresistive elements, AMR, GMR, TMR or Hall elements can be employed, which are interconnected with one another in such a fashion or whose magnetic signals are subtracted from one another such that the form of the resulting magnetic signal is similar to the form of the magnetic signal of a single measuring coil of an inductive magnetic detector.

Before the detection of the magnetic signals by the (in particular inductive) magnetic detector, the security element was magnetized by the aforementioned first magnetic field region, whose magnetic field strength is greater than the first and second coercive field strength, and subsequently magnetized by the aforementioned second magnetic field region, whose magnetic field strength is greater than the first coercive field strength, but smaller than the second coercive field strength, wherein the security element was magnetized by the second magnetic field region in a different direction than by the first magnetic field region.

The checking apparatus also has an evaluation device (which can be or is connected with the magnetic detector) which is adapted to evaluate the magnetic signals of the security element detected in the individual measuring tracks. The checking apparatus can be provided to be installed in an apparatus for processing value documents. The value document processing apparatus has a transport device for value documents which is configured to transport value documents one after the other along the transport direction past the (in particular inductive) magnetic detector of the checking apparatus.

For the first and second magnetization of the security element, the checking apparatus or the value document processing apparatus can have one or several magnets which, along the transport path of the value document, supply the aforementioned first magnetic field region for the first magnetization of the security element and (along the transport path behind the first magnetic field region) the aforementioned second magnetic field region for the second magnetization of the security element. Viewed along a transport path of the value document through the checking apparatus or through the value document processing apparatus, the first magnetic field region is arranged in front of the second magnetic field region and the magnetic detector is arranged behind the second magnetic field region. The magnetic field direction of the second magnetic field region is different from that of the first magnetic field region, for example substantially anti-parallel thereto. The magnetic field strength of the first magnetic field region is greater than the second coercive field strength. The first magnetic field region is adapted to align, in a security element transported through the first magnetic field region, the magnetization of the lowly coercive magnetic material and the magnetization of the highly coercive magnetic material in a first magnetization direction. The second magnetic field region is adapted to align, in the security element transported through the second magnetic field region, the magnetization of the lowly coercive magnetic material in a second magnetization direction different from the first magnetization direction, for example substantially anti-parallel to the first magnetization direction, however wherein the magnetization of the highly coercive magnetic material remains aligned in the first magnetization direction.

The evaluation device has evaluation software which is adapted to ascertain, for several or all of the measuring tracks, the strongest two local minima of the respective magnetic signal and/or the strongest two local maxima of the respective magnetic signal, which the respective magnetic signal of the respective measuring track has as a function of time or as a function of position along the transport direction of the value document in the region of the security element. Further, the software of the evaluation device is adapted to ascertain a minima comparison value of the respective measuring track by comparing the amplitude of the magnetic signal in the second strongest local minimum with the amplitude of the magnetic signal in the strongest local minimum and/or to ascertain a maxima comparison value of the respective measuring track by comparing the amplitude of the magnetic signal in the second strongest local maximum with the amplitude of the magnetic signal in the strongest local maximum. And the software of the evaluation device is adapted to check a magnetic coding of the security element on the basis of the minima comparison values of several of the measuring tracks and/or on the basis of the maxima comparison values of several of the measuring tracks.

For example, the software of the evaluation device is adapted to decide, when checking the magnetic coding of the security element on the basis of the minima comparison values and/or on the basis of the maxima comparison values of the individual measuring tracks, whether the security element is assigned to a first or a second security element category and/or to check whether the security element has a lowly coercive or a highly coercive magnetic region (or possibly a combined magnetic region) in the respective section (transverse to the transport direction of the value document) whose magnetic signal has been detected by the respective measuring track.

BRIEF DESCRIPTION OF THE DRAWINGS

Hereinafter the invention will be explained by way of example with reference to the following figures. The figures are described as follows.

DETAILED DESCRIPTION OF VARIOUS EMBODIMENTS

Figure 1:
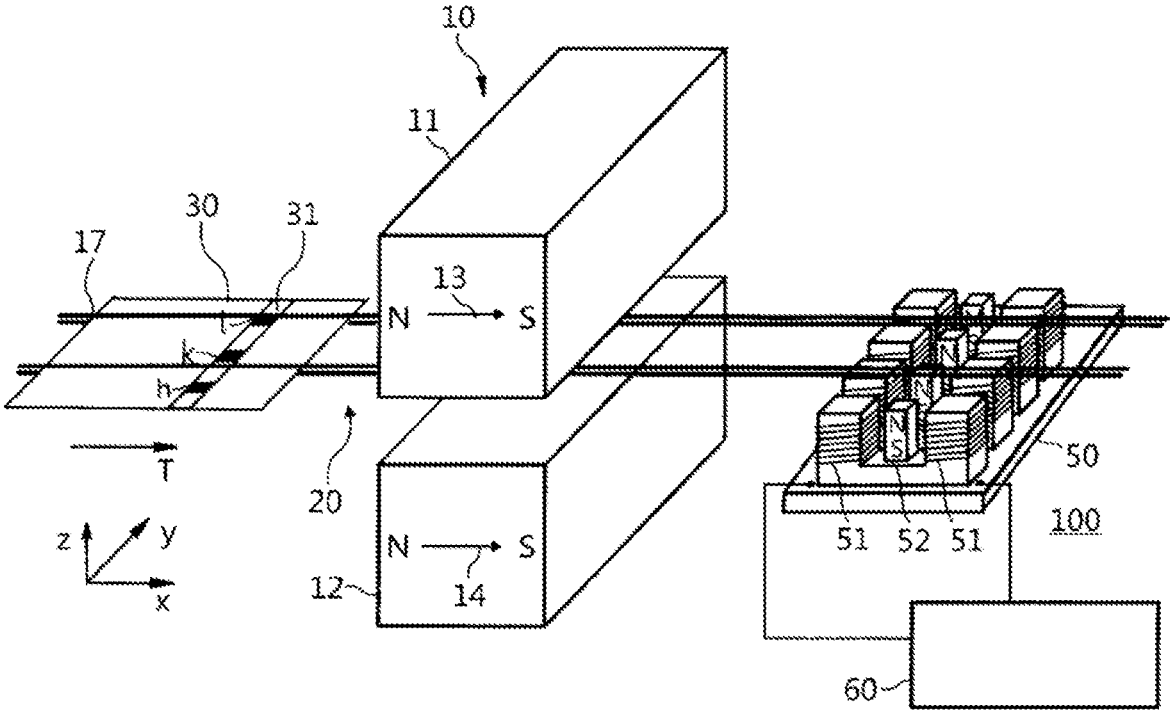
FIG. 1 a value document processing apparatus with a magnetization device, a magnetic detector and an evaluation device, FIG. 2 the course of the magnetic field lines for the magnetization device from FIG. 1, FIG. 3*a-d* magnetic signals of the inductive magnetic detector: for a lowly coercive magnetic region (FIG. 3*a*), for a highly coercive magnetic region (FIG. 3*b*), for a combined magnetic region (FIG. 3*c*), for a measuring track lying in the vicinity of the magnetic regions of the security element (FIG. 3*d*), FIG. 4*a-d* a first example of a security element (FIGS. 4*a*, 4*c*) and the minima ratio v (FIG. 4*b*) and the maxima ratio V (FIG. 4*d*) ascertained for this along the security element, FIG. 5*a-d* a second example of a security element (FIGS. 5*a*, 5*c*) and the minima ratio v (FIG. 5*b*) and the maxima ratio V (FIG. 5*d*) ascertained for this along the security element.

FIG. 1 schematically shows a detail from a value document processing apparatus which is adapted to check a magnetizable security element 31 of a value document 30. The value document processing apparatus contains a checking apparatus 100, which has an inductive magnetic detector 50 and an evaluation device 60, and possibly further elements (not shown), such as, for example, input and output devices for value documents and operating elements. The value document processing apparatus has a transport device 17 and a magnetization device 10 made up of two opposing magnets 11, 12, which are arranged along the transport path of the value document in front of the inductive magnetic detector 50 and spaced apart therefrom.

In this example, the security element 31 has a lowly coercive magnetic material with a first, small coercive field strength and a highly coercive magnetic material with a second, greater coercive field strength, which are contained in several sections of the security element transverse to the transport direction (y-direction). Thus, a highly coercive magnetic region h of the security element 31 has only the highly coercive magnetic material, but not the lowly coercive magnetic material, and a lowly coercive magnetic region 1 of the security element 31 only has the lowly coercive magnetic material, but not the highly coercive magnetic material. The security element 31 can alternatively also have only one type of these magnetic materials. Possibly, a combined magnetic region k can also be present, which has both aforementioned magnetic materials. The present magnetic regions h or 1 or h, 1 or h, k, 1 form a magnetic coding of the security element 31.

The value document 30 with the security element 31 is transported along a transport direction T by means of the transport device 17 of the value document processing apparatus. In FIG. 1, two upper and two lower transport belts are shown by way of example, between which the value document 30 is clamped and transported. But the transport device 17 can also comprise transport rollers. Before the security element 31 is checked, it is magnetized by the two magnets 11, 12 in such a fashion that the magnetization directions of the highly and lowly coercive magnetic regions h, 1 differ from one another. In the example of FIG. 1, the magnetization directions lie at least approximately anti-parallel to one another. For this purpose, the magnetization device supplies along the transport region a first magnetic field region 15 and a second magnetic field region 16 downstream of the first magnetic field region in the transport direction T, cf. FIG. 2.

The two magnetic field regions 15, 16 previously described are produced by means of two bar magnets 11, 12 which lie opposite one another with respect to both their north poles N and their south poles S. In the present embodiment example, the magnet axes 13 and 14 of the two magnets 11, 12 are aligned parallel to one another and to the transport direction T, but they can also lie contrary to the transport direction T. By employing two magnets arranged in this fashion to produce the two magnetic field regions 15, 16, an anti-parallel magnetization of the highly and lowly coercive magnetic regions is achieved with little effort.

Figure 2:
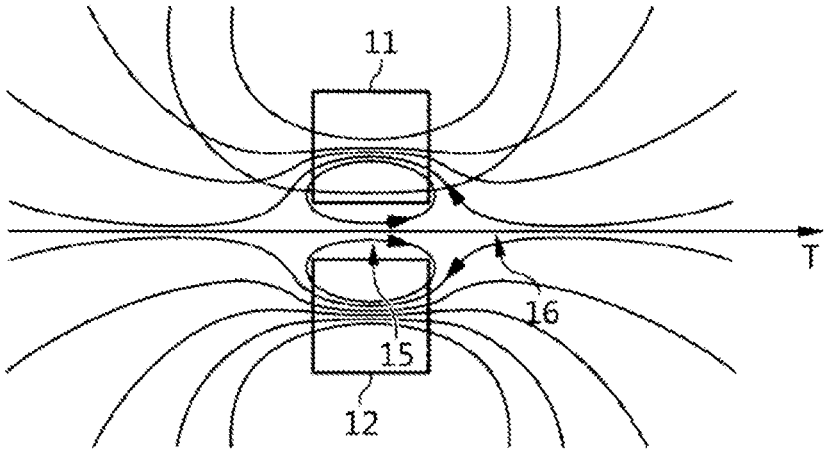

The magnetic field lines of the magnetic field produced by such a magnetization device 10 are shown schematically in FIG. 2, which shows these magnetic field lines in a plane parallel to the x and z axes of FIG. 1, which plane intersects the two magnets 11 and 12 in their center. Accordingly, viewed in the z-direction, a magnetic field aligned in the transport direction T (first magnetic field region 15) lies exactly in the center between the magnets and, viewed in the x-direction, between the poles N, S of the magnets 11, 12. Viewed in the transport direction T downstream thereof and behind the two magnets 11, 12, there is a magnetic field (second magnetic field region 16) with a smaller magnetic field strength, which is aligned contrary to the transport direction T. In the present example, the magnetic field directions are oriented parallel or anti-parallel to the transport direction of the value document. But one or both can also be oriented differently, for example perpendicularly to the transport direction T of the value document (parallel or anti-parallel to the y-direction or z-direction shown in FIG. 1) or obliquely to these directions.

Alternatively, the two magnetic regions 15, 16 can also be produced by a single magnet 11 or 12 or by two or four magnets whose magnet axes lie perpendicularly to the transport direction (z direction), for example which are arranged above and/or below the value document and face each other with their magnetic poles of the same name lying opposite one another. Instead of the anti-parallel alignment, other angles to one another can also be selected for the two magnetic field directions.

A first magnetization is achieved through the first magnetic field region 15, in which both the magnetization of the lowly coercive magnetic region 1 and that of the highly coercive magnetic region h are aligned along the transport direction T. In the second magnetic field region 16, only the magnetization of the lowly coercive magnetic region 1 is changed contrary to the transport direction T. Since the magnetic field strength of the second magnetic field region 16 is smaller than the second coercive field strength, the highly coercive magnetic region h is not re-magnetized by the second magnetic field region 16. The magnetization of the lowly coercive magnetic region 1 is, however, aligned approximately anti-parallel to the transport direction T by the second magnetization.

In this example, the combined magnetic region k is configured such that the lowly coercive magnetic material of the combined magnetic region and the highly coercive magnetic material of the combined magnetic region have at least approximately the same remanent flux density. When, in this case, the lowly coercive magnetic material of the combined magnetic region is magnetized anti-parallel to the highly coercive magnetic material of the combined magnetic region by the second magnetic field, a vanishing resultant magnetization of the respective combined magnetic region k is ideally achieved.

After the first and second magnetizations in the two magnetic field regions 15, 16, magnetic signals of the security element are detected by the inductive magnetic detector 50 and the magnetic signals are evaluated in order to check the magnetic coding of the security element. For spatially resolved capture of the magnetization of the security element, the inductive magnetic detector 50 has several measuring tracks L (four in FIG. 1), for each of which an inductive measuring head is available. Each of the inductive measuring heads has two measuring coils 51 with a soft-magnetic core and a magnet 52 located in between for producing a magnetic field that is constant over time. During the capture of the magnetic signals, the magnetic field produced by the respective magnet 52 acts on the security element 31. To produce the magnetic field constant over time, a single, appropriately dimensioned magnet can also be employed for all measuring tracks. When a magnetized security element 31 is transported past, a current is induced in the respective measuring coil 51. The measuring coils 51 produce corresponding signals, which are referred to as magnetic signals. The two measuring coils 51 of the respective measuring head are preferably connected in difference to one another, so that the difference signal of the two measuring coils 51 is produced as the magnetic signal for each measuring track L. This differential circuit makes it possible to minimize external magnetic influences acting simultaneously on both measuring coils 51, since the electrical signals of the measuring coils 51 cancel each other out in the case of contrarily directed interconnection. For further processing, the magnetic signals M of each measuring track L can each be amplified with a separate amplifier. The magnetic signals M produced in this fashion are subsequently evaluated by means of the evaluation device 60 in order to check the magnetic coding of the security element.

For example, to check the magnetic coding, the magnetic signals are only evaluated to the effect that the security element is assigned to one (of two or several) security element categories. For this purpose, it can be sufficient to determine whether the magnetic signal of a highly coercive magnetic region h (or possibly also of a combined magnetic region k) was detected in any of the measuring tracks L along the security element (multicode security element) or whether only other magnetic signals were detected (no multicode security element).

To check the magnetic coding, the magnetic signals of the security element can be evaluated with regard to the presence of the individual previously described magnetic regions h, 1 (and possibly also k) on the security element. Given a correspondingly high spatial resolution of the magnetic detector 50 compared to the length of the magnetic regions of the magnetic coding, the magnetic signals can possibly also be evaluated to identify each individual magnetic region and the sequence and arrangement of the magnetic regions on the security element in order to check the magnetic coding of the security element 31.

Figure 3A:
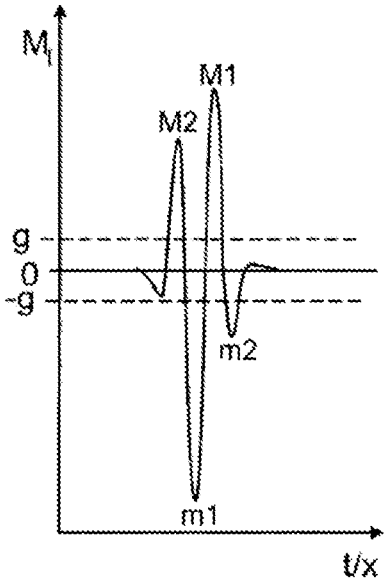
Figure 3B:
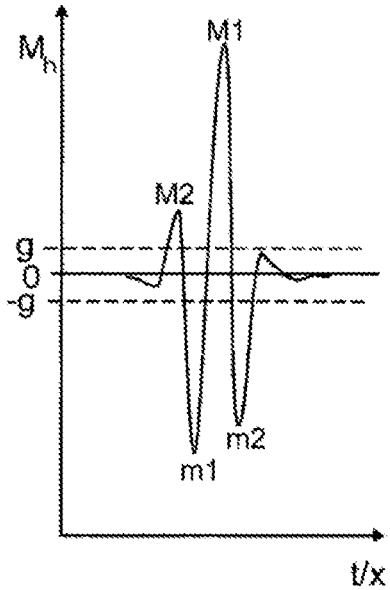
Figure 3C:
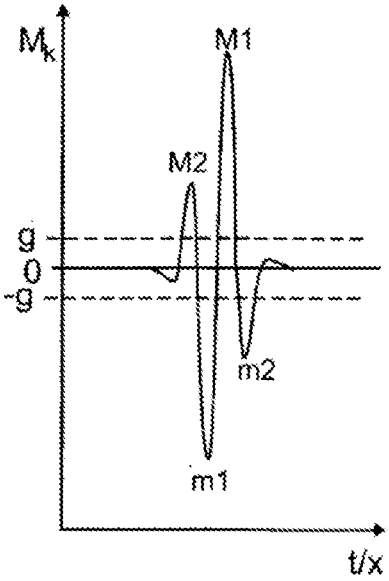
Figure 3D:
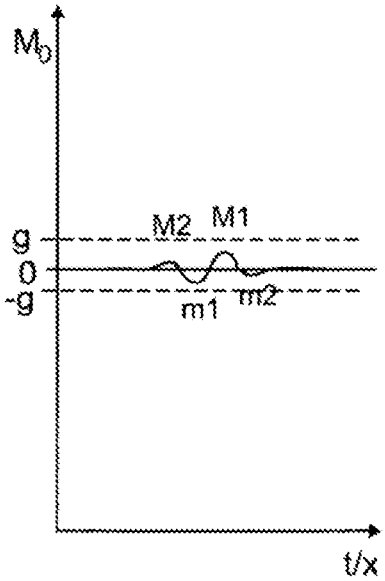

In FIG. 3*a*, the magnetic signal $M_1$ is shown by way of example, which the respective inductive measuring head of the magnetic detector 50 produces as a function of time t or as a function of position x along the value document transported past (at the magnetic detector 50), when a lowly coercive magnet transports region 1 is transported past it (differential circuit of the two measuring coils 51). The corresponding magnetic signal $M_h$ is shown in FIG. 3*b*, which the respective inductive measuring head produces when a highly coercive magnetic region h is transported past it. In FIG. 3*c*, the corresponding magnetic signal $M_k$ is shown, which the respective inductive measuring head produces when a combined magnetic region k is transported past it. And in FIG. 3*d* the corresponding magnetic signal $M_0$ is shown, which is detected in a measuring track L which lies outside the magnetic regions of the security element (offset thereto in the y-direction) but in the vicinity of the magnetic regions.

The exact form of the magnetic signals of the individual magnetic regions depends on the type of magnetic detector employed. The magnetic signals of the magnetic regions 1, h and k shown in FIGS. 3*a-d* have a complex structure made up of several minima and maxima. The complexity of these magnetic signals is based on the measuring technology employed, in which two inductive measuring heads are connected in difference. The difference between the magnetic signal $M_1$ of the lowly coercive magnetic region 1 compared to the magnetic signal $M_h$ of the highly coercive magnetic region h is based substantially on its reversed magnetization (produced by the magnetic field region 16).

However, the magnetic field of the magnet 52 located between the measuring heads also influences the form of the magnetic signals, since this magnetic field leads to a re-magnetization of the lowly coercive magnetic material during the detection process or between the detection processes of the two measuring coils 51. This applies in particular to the magnetic signal $M_k$ of the combined magnetic region k, which is magnetized by the second magnetic field region 16 in such a fashion that its magnetization resulting from the first and second magnetization almost disappears. Before the start of the measurement of the first measuring coil 51 there is therefore hardly any magnetization of the combined magnetic region k present, but after the first measuring coil 51 the magnet 52 produces a resulting magnetization through the above-mentioned re-magnetization of the lowly coercive magnetic material between the detection processes of the two measuring coils 51.

The magnetic signal $M_0$ also has maxima and minima, but has a significantly smaller amplitude than the other magnetic signals in which the respective magnetic region has exactly met with the respective measuring track in the y-direction. In order to rule out a misjudgment of the (too) low maxima and minima of the magnetic signal $M_0$, the absolute amount of the strongest maximum or the strongest minimum of the respective magnetic signal is compared with an insignificance threshold g, cf. FIGS. 3*a-d*. The comparison can be carried out by the magnetic detector 50 or the evaluation device 60. If the insignificance threshold g is undershot, as is the case here with the magnetic signal $M_0$, the magnetic signal of the respective measuring track L is ignored for the further evaluation. If the insignificance threshold g is exceeded, as is the case here with the magnetic signals $M_1$, $M_h$ and $M_k$, the respective magnetic signal is employed to check the coding of the security element.

The evaluation device 60, which is programmed with a corresponding evaluation software, ascertains for these magnetic signals $M_1$, $M_h$ and $M_k$ for example the respectively strongest two local minima m1, m2 of the respective magnetic signal (the local minima with the largest absolute value), which the respective magnetic signal of the respective measuring track L has as a function of position x or time tin the region of the security element. By comparing the amplitude of the magnetic signal in the second strongest local minimum m2 with the amplitude of the magnetic signal in the strongest local minimum m1, the evaluation device 60 determines a minima comparison value of the respective measuring track, for example a minimum ratio v=m2/m1 or v=m1/m2 or a minimum difference u=m1−m2 or u=m2−m1. In order to check the magnetic coding of the security element, the minima comparison values v or u of several measuring tracks L are evaluated.

As an alternative or in addition to the minima evaluation, the evaluation device can also carry out a maxima evaluation in which it ascertains the two strongest local maxima M1, M2 of the respective magnetic signal (the local maxima with the largest absolute value) and, by comparing the amplitude of the magnetic signal in the second strongest local maximum M2 with the amplitude of the magnetic signal in the strongest local maximum M1, determines a maxima comparison value of the respective measuring track L, for example a maxima ratio V=M2/M1 or V=M1/M2 or a maxima difference U=M1−M2 or U=M2−M1. In order to check the magnetic coding of the security element, the maxima comparison values V or U of several measuring tracks L can be evaluated alone or in addition to the minima comparison values u or v. Possibly, both can also be offset against each other.

In FIG. 4 *a*, an example of a security element 31 is shown, whose magnetic coding has only two lowly coercive magnetic regions 1. FIG. 4*b* shows the minima comparison values v=m2/m1, which the evaluation device ascertains from the magnetic signals of an inductive magnetic detector 50 with eight measuring tracks L1-L8 for the security element 31, cf. FIG. 1. The magnetic signals of the measuring tracks L2, L3 and L6 have minima comparison values v of around 0.25, as expected for lowly coercive magnetic regions 1. The magnetic signals of the remaining measuring tracks lie below the insignificance threshold g. The minima comparison values v=m2/m1 of the measuring tracks L2, L3, and L6 are compared with a first threshold t1 stored in the evaluation device 60, which amounts to around 0.35, for example. Due to the undershooting of the first threshold t1, it is concluded that the security element has lowly coercive magnetic regions 1 in the (y) sections whose magnetic signals have been detected by the measuring tracks L2, L3 and L6. The security element 31 from FIG. 4*a* is therefore assigned to a first category which is referred to, for example, as "magnetic coding without highly coercive magnetic material" or "no multicode security element".

Figure 4A:
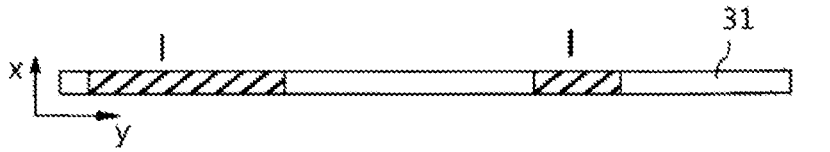
Figure 4B:
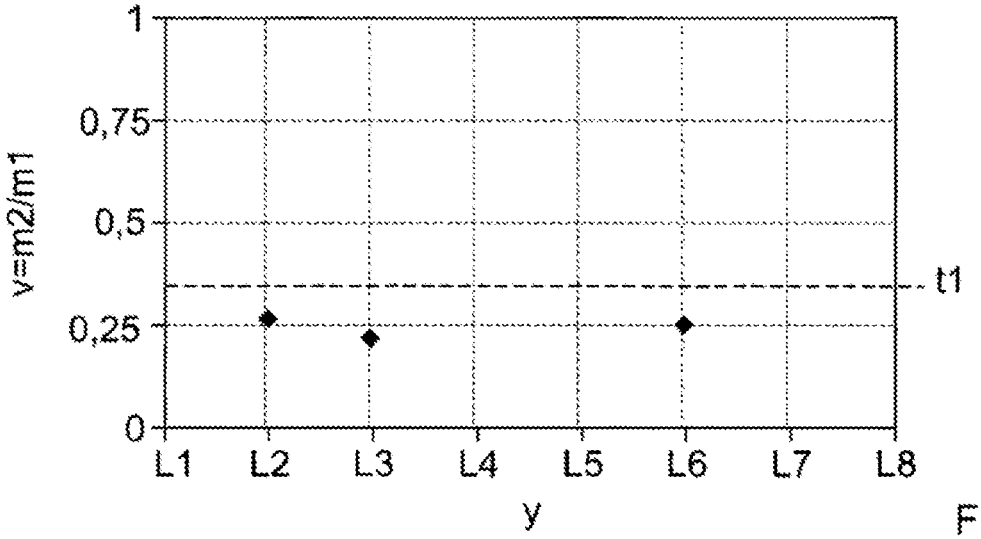
Figure 4C:
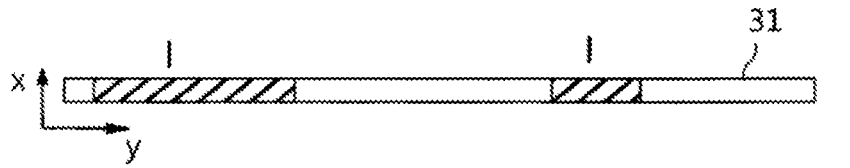
Figure 4D:
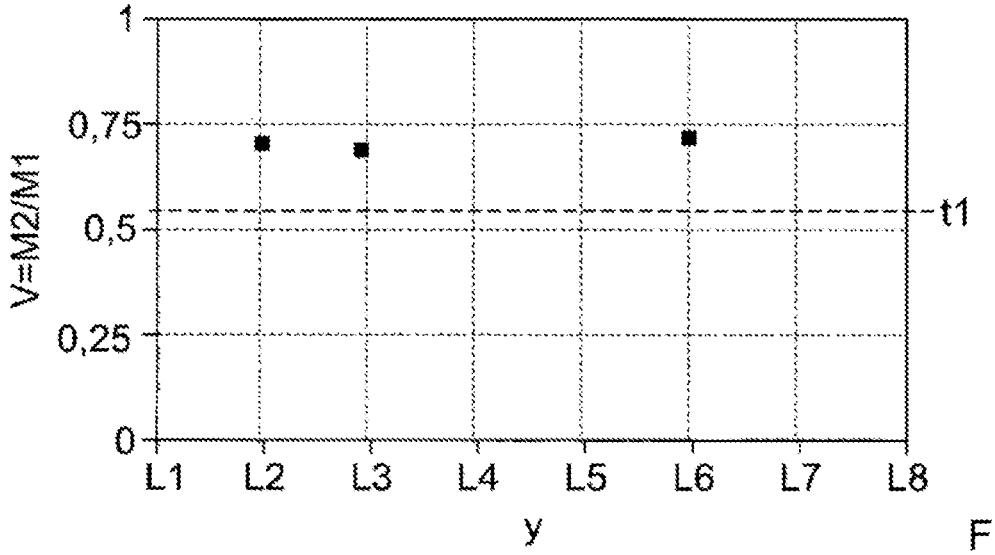

FIG. 4*c* is identical to FIG. 4*a*. FIG. 4*d* shows the corresponding maxima comparison values V=M2/M1 for the security element 31 from FIGS. 4*a, c*, which were ascertained for the magnetic signals of the measuring tracks L2, L3 and L6. The maxima comparison values V of these measuring tracks are in the range 0.7 and thus above a first threshold t1=0.55 (selected differently for the maxima evaluation) with which they are compared. Due to the exceeding of the first threshold t1, it is concluded also in the maxima evaluation that the magnetic signals detected in the measuring tracks L2, L3 and L6 were produced by lowly coercive magnetic regions. The security element 31 from FIGS. 4*a, c* is therefore also assigned to the first category ("magnetic coding without highly coercive magnetic region" or "no multicode security element") by the maxima evaluation.

Figure 5A:
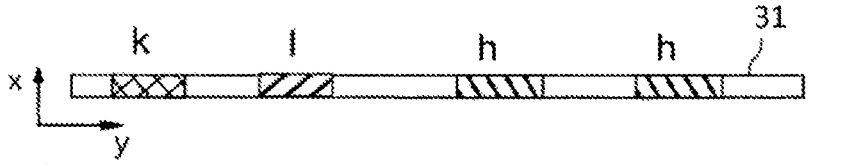
Figure 5B:
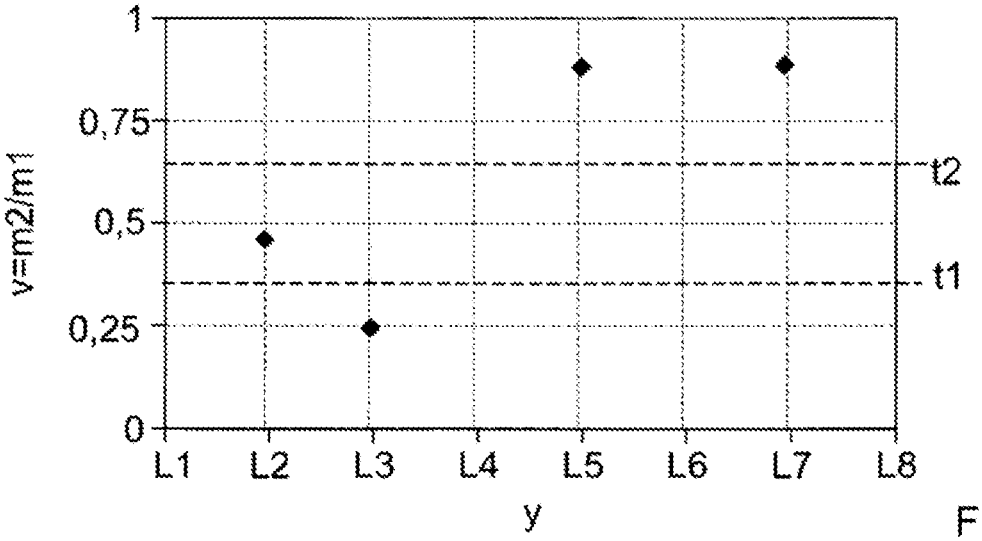
Figure 5C:
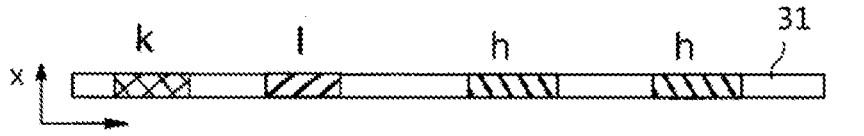
Figure 5D:
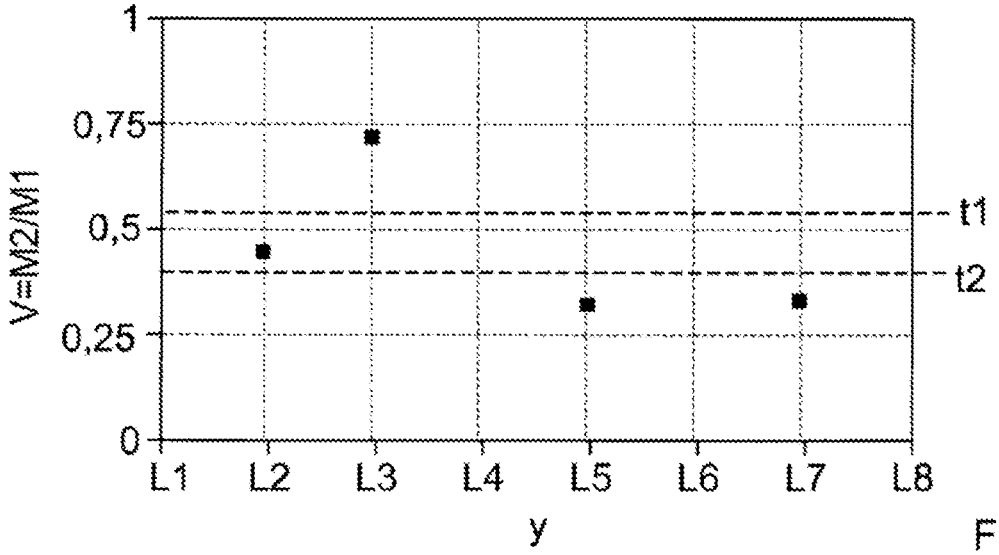

In FIG. 5*a* (identical to FIG. 5*c*) another example of a security element 31 is shown, whose magnetic coding has two highly coercive magnetic regions h and a lowly coercive magnetic region 1 and a combined magnetic region k. Its minima evaluation is shown on the basis of FIG. 5*b* and its maxima evaluation on the basis of FIG. 5*d*.

From the magnetic signals (cf. FIG. 3*a-c*) of a magnetic detector 50 with 8 measuring tracks L1-L8, the evaluation device 60 ascertains the minima comparison values v=m2/m1, cf. FIG. 5 *b*, for the security element 31 from FIGS. 5*a, c*. A minima comparison value v of around 0.25, as expected for a lowly coercive magnetic region 1, is ascertained only for the magnetic signal of the measuring track L3. For the magnetic signals of the measuring tracks L5 and L7, significantly larger minima comparison values v in the range 0.85 are ascertained. A minima comparison value v of around 0.45 is ascertained for the magnetic signal of the measuring track L2 and the magnetic signals of the remaining measuring tracks lie below the insignificance threshold g. The minima comparison values v=m2/m1 of the measuring tracks L2, L3, L5 and L7 are also compared here with the first threshold t1=0.35, which is stored in the evaluation device 60 for the minima evaluation. Due to the exceeding of the first threshold t1 in the measuring tracks L2, L5 and L7, it is concluded that the magnetic signal detected there was not produced by lowly coercive magnetic regions, but that the security element must have sections with highly coercive magnetic material. The security element 31 from FIG. 5*a, c* is therefore assigned to a second category, which is referred to, for example, as "magnetic coding with highly coercive magnetic material" or "multicode security element".

The assignment of the security element 31 to the second category can be linked to the condition that the first threshold t1 must be exceeded for the minima comparison values of at least n measuring tracks L for the security element 31 to be assigned to the second category ("multicode security element"). For example, n=2, so that the minima comparison values of the first threshold t1 must be exceeded at at least two of the measuring tracks L for the security element 31 to be assigned to the second category. If, on the other hand, the first threshold t1 is only exceeded at a single measuring track L (i.e. less than n=2), the security element 31—like the security elements without highly coercive magnetic material—is assigned to the first category ("no multicode security element"). The minimum number n>1 (instead of n=1) is preferably used to check security elements whose magnetic coding is known to have more than one highly coercive or combined magnetic region h, k or one or several long magnetic regions h or k. This is because n>1 then ensures that a single magnetic signal whose minima comparison value exceeds the first threshold t1 does not yet lead to the security element being classified as a "multicode security element", but only when this is the case in at least n measuring tracks L.

If the evaluation device is also to be adapted to differentiate between combined magnetic regions k and highly coercive magnetic regions, a second threshold t2 can be stored in the software with which the minima comparison values v or the maxima comparison values V are compared. The second threshold t2 lies above the first threshold t1 for the minima evaluation, for example at around t2=0.65, in the maxima evaluation below the first threshold t1, for example at around t2=0.4. In the security element from FIGS. 5*a, c*, a magnetic signal is detected in the measuring track L2, whose minima comparison value v is around 0.45 and therefore lies above the first threshold t1 and below the second threshold t2, while the minima comparison value v for the measuring tracks L5 and L7 also exceed the second threshold t2, cf. FIG. 5*b*. Based on the finding that a minima comparison value lying between the two thresholds t1 and t2 is ascertained for at least one measuring track (here only L2), the security element can be assigned to a possibly employed third category ("multicode security element with combined magnetic region"). However, a corresponding categorization of the security element from FIGS. 5*a, c* can also take place on the basis of the maxima evaluation, based on the maxima comparison value of around 0.45, which also lies between the two thresholds t1 and t2, while the maxima comparison values V for the measuring tracks L5 and L7 undershoot the second threshold t2, cf. FIG. 5*d*.

For a more precise check of the magnetic coding, if the first threshold t1 is undershot in the case of the minima evaluation, it can be concluded that the security element from FIG. 4*a* has one or several lowly coercive magnetic regions 1 in the y-sections, which correspond to the measuring tracks L2, L3 and L6, and no magnetic material (i.e. gap regions of the magnetic coding) in the remaining measuring tracks. For the security element from FIG. 5*a*, on the basis of the exceeding of the first threshold t1 in the measuring tracks L2, L5 and L7 in the case of the minima evaluation, it can be concluded that the security element has one or several highly coercive or combined magnetic regions k in the y-sections that correspond to the measuring tracks L2, L5 and L7 and—on the basis of the undershooting of the first threshold t1 in the measuring tracks L3—that the security element has a lowly coercive magnetic region 1 in the y-section corresponding to the measuring track L3. The relative or absolute y-positions of the lowly coercive magnetic regions 1, of the highly coercive magnetic regions h (and, possibly, the combined magnetic regions k) of the security element for a more precise check can be compared with reference data stored in the evaluation device 60 for several known security elements. On the basis of this comparison, the magnetic coding can, possibly, also be checked with regard to the sequence and/or arrangement of the various magnetic regions.

The invention claimed is:

1. A method for checking a value document which has a security element with at least one lowly coercive magnetic region and/or with at least one highly coercive magnetic region, wherein the lowly coercive magnetic region contains a lowly coercive magnetic material with a first coercive field strength, and the highly coercive magnetic region contains a highly coercive magnetic material with a second coercive field strength which is greater than the first coercive field strength, wherein the following steps are carried out in the method:

first magnetization of the security element by a first magnetic field region whose magnetic field strength is greater than the second coercive field strength, so that the magnetization of the possibly present lowly coercive magnetic material and the magnetization of the possibly present highly coercive magnetic material are aligned in a first magnetization direction, second magnetization of the security element by a second magnetic field region whose magnetic field strength is greater than the first coercive field strength, but smaller than the second coercive field strength, wherein the magnetic field direction of the second magnetic field region is oriented such that the magnetization of the possibly present lowly coercive magnetic material is aligned due to the second magnetization in a second magnetization direction different from the first magnetization direction, transporting the value document along a transport direction past a magnetic detector, in particular an inductive magnetic detector, which has several measuring tracks transverse to the transport direction of the value document, in which the magnetic detector detects a magnetic signal in each case as a function of time, evaluating the magnetic signals of the security element detected by the individual measuring tracks, wherein for several of the measuring tracks in each case the two strongest local minima of the respective magnetic signal and/or the strongest two local maxima of the respective magnetic signal are ascertained, which the respective magnetic signal of the respective measuring track has as a function of time, a minima comparison value of the respective measuring track is determined by comparing the amplitude of the magnetic signal in the second strongest local minimum with the amplitude of the magnetic signal in the strongest local minimum and/or a maxima comparison value of the respective measuring track is determined by comparing the amplitude of the magnetic signal in the second strongest local maximum with the amplitude of the magnetic signal in the strongest local maximum, and checking a magnetic coding of the security element on the basis of the minima comparison values of several of the measuring tracks, and/or on the basis of the maxima comparison values of several of the measuring tracks.

2. The method according to claim 1, wherein, when checking the magnetic coding of the security element, it is checked for several of the measuring tracks, in each case on the basis of the minima comparison value and/or on the basis of the maxima comparison value of the respective measuring track, whether the security element has a lowly coercive magnetic region or a highly coercive magnetic region in the respective section whose magnetic signal has been detected by the respective measuring track.

3. The method according to claim 1, wherein, when checking the magnetic coding of the security element, it is decided on the basis of the minima comparison values and/or on the basis of the maxima comparison values of several measuring tracks whether the security element is assigned to a first or a second security element category.

4. The method according to claim 3, wherein the security element is assigned to a first security element category if, for a minimum number of measuring tracks, the minima comparison value computed for the respective measuring track exceeds the first threshold and/or for a minimum number of measuring tracks the maximum value computed for the respective measuring track undershoots the first threshold, and otherwise the security element is assigned to a second security element category.

5. The method according to claim 1, wherein the absolute amount of the strongest local minimum of the respective magnetic signal or the absolute amount of the strongest local maximum of the respective magnetic signal, which the respective magnetic signal of the respective measuring track has as a function of time, is compared with an insignificance threshold and, if the insignificance threshold is exceeded, it is concluded that the security element has a magnetic region in the respective section of the security element whose magnetic signal has been detected by the respective measuring track.

6. The method according to claim 1, wherein the minima comparison value of the respective measuring track is a minima difference between the amplitude of the magnetic signal in the second strongest local minimum and the amplitude of the magnetic signal in the strongest local minimum or vice versa, or that the minima comparison value of the respective measuring track is a minima ratio between the amplitude of the magnetic signal in the second strongest local minimum and the amplitude of the magnetic signal in the strongest local minimum or vice versa.

7. The method according to claim 1, wherein the maxima comparison value of the respective measuring track is a maxima difference between the amplitude of the magnetic signal in the second strongest local maximum and the amplitude of the magnetic signal in the strongest local maximum or vice versa, or that the maxima comparison value is a maxima ratio between the amplitude of the magnetic signal in the second strongest local maximum and the amplitude of the magnetic signal in the strongest local maximum or vice versa.

8. The method according to claim 1, wherein for one or several measuring tracks of the magnetic detector the respective minima comparison value and/or the respective maxima comparison value is compared with a first threshold, wherein the magnetic coding of the security element is checked in particular based on whether the minima comparison value(s) of the respective measuring track exceed(s) or undershoot(s) the first threshold and/or based on whether the maxima comparison value(s) of the respective measuring track undershoot(s) or exceed (s) the first threshold.

9. The method according to claim 8, wherein depending on whether the minima comparison value of the respective measuring track exceeds or undershoots the first threshold and/or depending on whether the maxima comparison value of the respective measuring track undershoots or exceeds the first threshold, it is decided whether the security element has a highly coercive or a lowly coercive magnetic region in the respective section whose magnetic signal has been detected by the respective measuring track.

10. The method according to claim 8, wherein for one or several measuring tracks of the magnetic detector the respective minima comparison value and/or the respective maxima comparison value is additionally compared with a second threshold, and in the case that the minima comparison value(s) of the respective measuring track and/or the maxima comparison value(s) of the respective measuring track lies between the first threshold and that of the second threshold, it is decided that the security element has a combined magnetic region which has both the highly coercive and the lowly coercive magnetic material in the respective section whose magnetic signal has been detected by the respective measuring track.

11. A checking apparatus for checking a value document which has a security element with at least one lowly coercive magnetic region and/or with at least one highly coercive magnetic region, wherein the highly coercive magnetic region has a highly coercive magnetic material with a second coercive field strength whose magnetization is aligned in a first magnetization direction, and the lowly coercive magnetic region contains a lowly coercive magnetic material with a first coercive field strength which is smaller than the second coercive field strength, wherein the magnetization of the highly coercive magnetic material is aligned in a first magnetization direction and the magnetization of the lowly coercive magnetic material is aligned in a second magnetization direction different from the first magnetization direction, wherein the checking apparatus has the following:

a magnetic detector, in particular an inductive magnetic detector, which is adapted to detect magnetic signals of the value document transported along a transport direction past the magnetic detector, wherein the magnetic detector has several measuring tracks transverse to the transport direction of the value document and is adapted to detect in the measuring tracks a magnetic signal in each case as a function of time, an evaluation device which is adapted to evaluate the magnetic signals of the security element which are detected by the magnetic detector in the individual measuring tracks, wherein the evaluation device is adapted for several of the measuring tracks in each case to ascertain the strongest two local minima of the respective magnetic signal and/or the strongest two local maxima of the respective magnetic signal, which the respective magnetic signal of the respective measuring track as a function of time, and to determine a minima comparison value of the respective measuring track by comparing the amplitude of the magnetic signal in the second strongest local minimum with the amplitude of the magnetic signal in the strongest local minimum and/or to determine a maxima comparison value of the respective measuring track by comparing the amplitude of the magnetic signal in the second strongest local maximum with the amplitude of the magnetic signal in the strongest local maximum, and wherein the evaluation device is adapted to check a magnetic coding of the security element on the basis of the minima comparison values of several of the measuring tracks and/or on the basis of the maxima comparison values of several of the measuring tracks.

12. The checking apparatus according to claim 11, wherein the evaluation device is adapted, when checking the magnetic coding of the security element for several of the measuring tracks in each case on the basis of the minima comparison value and/or on the basis of the maxima comparison value of the respective measuring track, to decide whether the security element is assigned to a first or a second security element category, and/or to check whether the security element has a lowly coercive or a highly coercive magnetic region in the respective section whose magnetic signal has been detected by the respective measuring track.

13. The checking apparatus according to claim 11, wherein the checking apparatus has one or several magnets which supply a first magnetic field region for the first magnetization of the security element and a second magnetic field region for the second magnetization of the security element, which, viewed along a transport path of the value document through the checking apparatus, is arranged behind the first magnetic field region and in front of the magnetic detector, wherein the magnetic field strength of the first magnetic field region is greater than that of the second magnetic field region and wherein the magnetic field direction of the second magnetic field region is different from that of the first magnetic field region.

14. A value document processing apparatus with a checking apparatus according to claim 11, and a transport device for transporting the value document past the magnetic detector along a transport direction.

15. The value document processing apparatus according to claim 14 with a checking apparatus wherein the checking apparatus has one or several magnets which supply a first magnetic field region for the first magnetization of the security element and a second magnetic field region for the second magnetization of the security element, which, viewed along a transport path of the value document through the checking apparatus, is arranged behind the first magnetic field region and in front of the magnetic detector, wherein the magnetic field strength of the first magnetic field region is greater than that of the second magnetic field region and wherein the magnetic field direction of the second magnetic field region is different from that of the first magnetic field region, wherein the magnets of the checking apparatus, which supply the first and second magnetic field regions, are arranged along the transport path of the value document through the value document processing apparatus spaced apart from the magnetic detector.

* * * * *